US008584690B2

(12) United States Patent
Ashton et al.

(10) Patent No.: US 8,584,690 B2
(45) Date of Patent: Nov. 19, 2013

(54) MATERIAL DELIVERY SYSTEMS AND METHODS

(75) Inventors: Kim J. Ashton, Racine, WI (US); Erik G. Miller, Scotts Valley, CA (US); William E. Simpson, New Berlin, WI (US)

(73) Assignee: Diversey, Inc., Sturtevant, WI (US)

( * ) Notice: Subject to any disclaimer, the term of this patent is extended or adjusted under 35 U.S.C. 154(b) by 436 days.

(21) Appl. No.: 12/674,264

(22) PCT Filed: Sep. 5, 2008

(86) PCT No.: PCT/US2008/075391

§ 371 (c)(1),
(2), (4) Date: Feb. 19, 2010

(87) PCT Pub. No.: WO2009/033016

PCT Pub. Date: Mar. 12, 2009

(65) Prior Publication Data

US 2011/0297238 A1 Dec. 8, 2011

Related U.S. Application Data

(60) Provisional application No. 60/970,632, filed on Sep. 7, 2007.

(51) Int. Cl.
*F17D 3/00* (2006.01)

(52) U.S. Cl.
USPC ..... 137/5; 137/4; 137/93; 137/92; 134/18; 134/56 D; 134/57 D; 134/58 D; 134/93

(58) Field of Classification Search
USPC ..... 137/93, 92, 4, 5; 134/57 D, 56 D, 58 D, 134/93, 94, 18; 222/36, 37, 38
See application file for complete search history.

(56) References Cited

U.S. PATENT DOCUMENTS 4,063,663 A * 12/1977 Larson et al. ..... 222/52
4,485,789 A * 12/1984 Walter et al. ..... 123/467

(Continued)

FOREIGN PATENT DOCUMENTS

EP 0509586 10/1992
JP 02647744 8/1997

(Continued)

OTHER PUBLICATIONS

The International Search Report prepared by the Korean Intellectual Property Office.

*Primary Examiner* — Eric Keasel
*Assistant Examiner* — Minh Le
(74) *Attorney, Agent, or Firm* — Michael Best & Friedrich LLP

(57) ABSTRACT

A method of determining an operational parameter of a washing system having a wash tank to which water and material are added. In some embodiments, the method includes establishing a communication link between a sensor and a controller. The sensor is positioned in the wash tank and transmits a signal indicative of a material concentration. The controller receives the signal. Additionally, the method includes adding material to water in the wash tank, monitoring the material concentration while material is being added, and stopping the material addition upon the material concentration reaching a predetermined material concentration. The controller then determines an operational parameter indicative of the amount of material that is needed to reach the predetermined material concentration.

17 Claims, 3 Drawing Sheets

(56) References Cited

U.S. PATENT DOCUMENTS

| | | | | |
|---|---|---|---|---|
| 4,509,543 | A | 4/1985 | Livingston et al. | |
| 4,733,798 | A | 3/1988 | Brady et al. | |
| 4,756,321 | A * | 7/1988 | Livingston et al. | 134/56 D |
| 4,848,381 | A | 7/1989 | Livingston et al. | |
| 4,956,887 | A | 9/1990 | Hakulinen | |
| 5,370,743 | A * | 12/1994 | Usui et al. | 134/18 |
| 5,448,115 | A | 9/1995 | Howland et al. | |
| 5,500,050 | A | 3/1996 | Chan et al. | |
| 5,556,478 | A | 9/1996 | Brady et al. | |
| 5,647,391 | A * | 7/1997 | Chan et al. | 137/93 |
| 5,681,400 | A * | 10/1997 | Brady et al. | 134/18 |
| 5,782,109 | A | 7/1998 | Spriggs et al. | |
| 6,223,129 | B1 * | 4/2001 | Chan et al. | 702/30 |
| 6,415,469 | B1 | 7/2002 | Diaz Fernandez et al. | |
| 6,453,927 | B1 * | 9/2002 | Peterson et al. | 137/3 |
| 6,792,637 | B2 | 9/2004 | Reichold et al. | |
| 6,819,977 | B2 | 11/2004 | Howes, Jr. et al. | |
| 6,892,143 | B2 | 5/2005 | Howes, Jr. et al. | |
| 6,895,307 | B2 | 5/2005 | Gardner, Jr. | |
| 6,990,411 | B2 | 1/2006 | Peterson et al. | |
| 7,802,335 | B2 * | 9/2010 | Hoppe et al. | 8/158 |
| 7,977,101 | B2 * | 7/2011 | Chan et al. | 436/55 |
| 2002/0117187 | A1 | 8/2002 | Helminger | |
| 2005/0000544 | A1 | 1/2005 | Cho et al. | |
| 2005/0268943 | A1 | 12/2005 | Schleifer | |
| 2006/0162466 | A1 | 7/2006 | Wargo et al. | |
| 2007/0044819 | A1 * | 3/2007 | Chan et al. | 134/18 |
| 2007/0113595 | A1 | 5/2007 | Harwood et al. | |
| 2008/0054014 | A1 | 3/2008 | Webster et al. | |
| 2009/0159098 | A1 * | 6/2009 | Schepers et al. | 134/18 |
| 2010/0229855 | A1 * | 9/2010 | Howgill | 128/200.23 |

FOREIGN PATENT DOCUMENTS

| | | |
|---|---|---|
| JP | 10-127985 | 5/1998 |
| JP | 10127985 | 5/1998 |
| JP | 2001-139099 | 5/2001 |
| JP | 2001139099 | 5/2001 |
| JP | 2001-334095 | 12/2001 |
| JP | 2006-528051 | 12/2006 |
| KR | 10-1997-0062159 | 9/1997 |
| KR | 10-1998-0017289 | 6/1998 |
| KR | 10-2003-0004715 | 1/2003 |
| WO | 93/17611 | 9/1993 |

* cited by examiner

MATERIAL DELIVERY SYSTEMS AND METHODS

BACKGROUND

The invention generally relates to material dispensing systems. More specifically, the invention relates to methods and systems of operating and controlling material dispensing systems.

As washing machines (e.g., dish washing machines, clothes washing machines, etc.) have become more sophisticated, systems have been implemented to automatically feed such machines with detergents, sanitizers, rinse aids, and the like, which may be produced in liquid, condensed, compressed, granulated, and/or powdered form. Such materials may be automatically delivered to a variety of types of washing machines, and their concentration monitored by a permanently installed sensor. Generally, such sensors must be maintained and cleaned to ensure proper operation.

SUMMARY

In one embodiment, a method of determining one or more operational parameters of a washing system having a wash tank to which water and material are added includes establishing a communication link between a sensor and a controller. The sensor is positioned in the wash tank and transmits a signal indicative of a material concentration to the controller, which receives the signal. The method also includes adding material to water in the wash tank, monitoring the material concentration while material is being added, and stopping the material addition upon the material concentration reaching a predetermined material concentration. Additionally, the method includes determining, by the controller, an operational parameter indicative of the amount of material that is needed to reach the predetermined material concentration.

In another embodiment, the invention provides a system for determining one or more operational parameters of a washing system having a wash tank to which water and material are added. The system includes a sensor and a dispensing device having a controller. The sensor is positioned in the wash tank and generates a signal indicative of a material concentration. The dispensing device dispenses a metered amount of material into the wash tank. The controller receives the signal from the sensor, determines the material concentration in the wash tank, and determines a correlation between the material concentration and the amount of material that is dispensed into the wash tank.

In another embodiment, a method of determining one or more operational parameters of a washing system having a wash tank to which water and material are added includes receiving, by a controller, from a sensor, a signal indicative of a material concentration in the wash tank. The method also includes supplying the wash tank with a metered amount of material, the material being added until a desired material concentration is achieved in the wash tank. Additionally, the method includes recording, by the controller, an operational parameter indicative of the amount of material required to achieve the desired material concentration.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Embodiments of the invention relate to systems and methods of determining a quantity of material that is provided to a wash tank of a washing system. Embodiments of the invention also relate to determining a correlation between a quantity of material that is provided to a wash tank and a material concentration in the wash tank. In an embodiment, a dose (or number of doses) of material is added to the wash tank while a sensor monitors the concentration of material in the wash tank. Upon the material concentration reaching a predetermined amount, a controller determines the number of doses, and, correspondingly, the amount of material that was added to the wash tank to achieve the desired material concentration. Such data can be compiled during a training mode and used to control future washing system operations. It is to be appreciated that embodiments herein do not require the sensor to be permanently installed in the wash tank, thereby potentially reducing upkeep and maintenance associated with the sensor.

Figure 1:
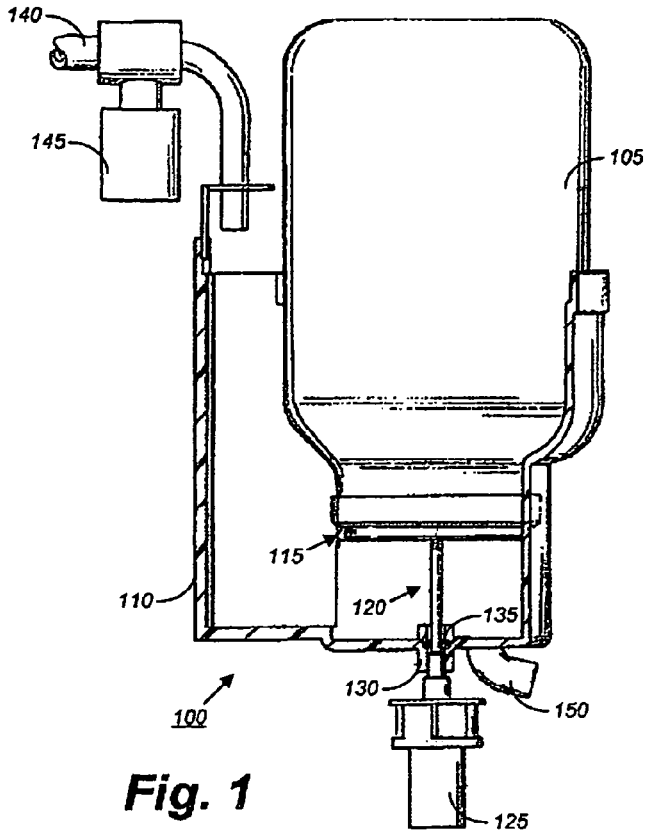
FIG. 1 illustrates an exemplary dispensing system, according to an embodiment of the invention.

FIG. 1 illustrates an exemplary dispensing system 100. While the construction and operation of the illustrated dispensing system will be described below, greater detail regarding this and other systems is described in U.S. patent application Ser. No. 11/404,518, which is hereby incorporated by reference. In some embodiments, the dispensing system 100 is configured to dispense or deliver a granulated material or powder (e.g., a chemical such as a detergent, a sanitizer, a rinse aid, etc.). In some embodiments, the dispensing system 100 is adapted for use in or with a larger washing system (e.g., the washing system shown in FIG. 3). For example, in some embodiments, a granular or powder material is delivered to a clothes washing machine or a dish washing machine. In the embodiment shown in FIG. 1, the dispensing system 100 generally includes a granulated material or powder container 105 that is supported in a dispenser assembly or receptacle 110. The container 105 is closed on one end by a metering and dispensing closure 115, which, as described in greater detail with respect to FIG. 2, can deliver or dose a predetermined amount of material from the container 105 into the receptacle 110. For example, in one embodiment, the dispensing closure 115 is rotated by a drive shaft 120 to deliver the material. The drive shaft 120 is driven by a drive member 125, and is journalled in a collar 130 with a seal 135.

The dispensing system 100 also includes a water intake conduit 140 that is controlled by a solenoid valve 145. The water intake conduit 140 and solenoid valve 145 are utilized to introduce water into the receptacle 110. For example, in some embodiments, when the solenoid valve 145 is energized, water from the water intake conduit 140 is allowed to enter the receptacle 110. Alternatively, when the solenoid valve 145 is de-energized, water is prevented from entering the receptacle 110. In other embodiments, a valve mechanism other than the solenoid valve 145 may be used.

A water solution outlet conduit 150 is also in communication with the receptacle 110. For example, the outlet conduit 150 allows water to exit the receptacle 110. In some embodiments, as described in greater detail below, water is mixed with dispensed material prior to exiting the receptacle 110 through the outlet conduit 150. In the embodiment shown in FIG. 1, liquid or solution is allowed to exit the receptacle 110 through the outlet conduit 150 relatively unobstructed. In other embodiments, the outlet conduit 150 may include a solenoid valve or other valve, similar to the solenoid valve 145.

In some embodiments, as described in greater detail below, the dispensing system 100 can also include electronic components such as a controller and one or more conductivity sensors. For example, in one embodiment, one or more conductivity sensors are positioned in the receptacle 110 to monitor the conductivity of the receptacle 110 (and the liquid disposed therein).

Figure 2:
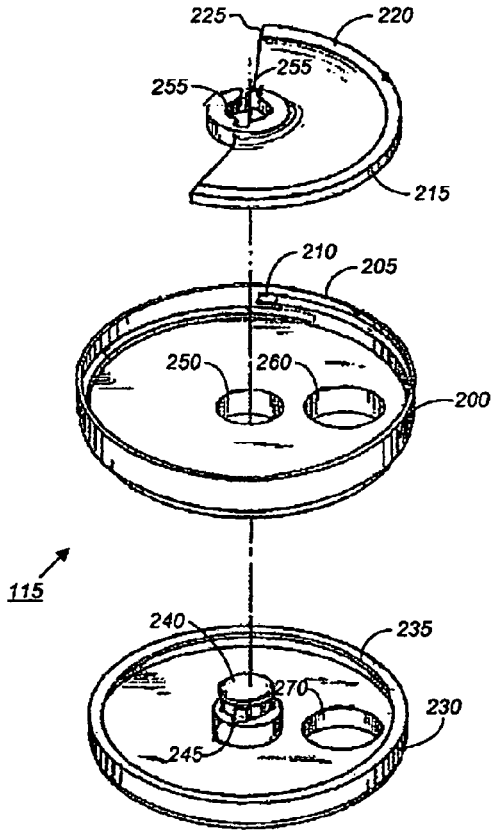
FIG. 2 illustrates an exemplary dispensing closure, according to an embodiment of the invention.

As shown in FIG. 2, the metering and dispensing closure 115 is generally composed of three basic components. For example, the closure 115 generally includes a cap member 200 with an upstanding wall 205 and internal threads 210 for engaging complementary threads on the container 105. The second component is a rotatable disk 215 with a raised peripheral wall 220, as well as a cutaway portion 225. Rotatable disk 215 is configured to be seated inside the cap member 200. The third component is a rotatable disk 230 with a raised peripheral wall 235 and a stub shaft 240 with projections 245. These projections 245 fit through an opening 250 in the cap member 200 such that the projections 245 engage slots 255 in the rotatable disk 215. Rotatable disks 215 and 230 are rotated by the shaft 120 (see FIG. 1) connected to the stub shaft 240.

Referring to FIGS. 1 and 2, in operation, the container 105 holding the material is supported in the receptacle 110. Water is introduced into the receptacle 110 through the water intake conduit 140. The metering and dispensing closure 115 is attached to the container 105. When the disks 215 and 230 of the closure 115 are properly aligned, the material from the container 105 is free to enter into a measuring opening or chamber 260 as it is uncovered by disk 215 and cutaway 225 (see FIG. 2). However, the material from the container 105 cannot pass into the receptacle 110, as the passage is blocked by rotatable disk 230. Activation of the drive member 125 and rotation of the drive shaft 120 causes the upper rotatable disk 215 and the lower rotatable disk 230 to move to a second position in which no more material can enter the opening 260, which has become a measuring chamber. Continued rotation of the disks 215 and 230 allows for the opening 260 to be positioned over opening 270, which allows the dose of material from the measuring chamber to flow into the receptacle 110 and be mixed with water from the intake conduit 140. The mixed material then exits the receptacle 110 through the water solution outlet conduit 150. In some embodiments, multiple doses are delivered during a single delivery cycle.

Figure 3:
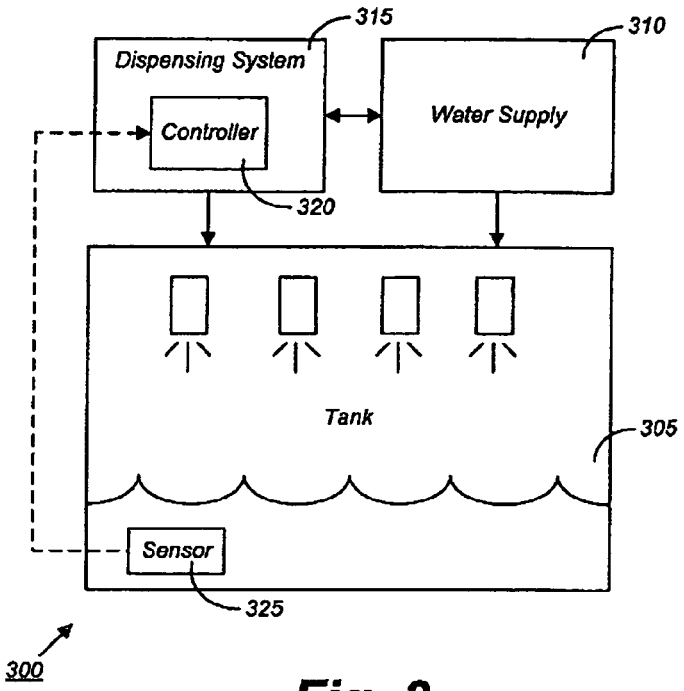
FIG. 3 illustrates an exemplary washing system, according to an embodiment of the invention.

FIG. 3 illustrates an exemplary washing system 300. In some embodiments, the washing system 300 is configured to clean and sanitize dishes and utensils ("ware"). In other embodiments, the washing system 300 is configured to wash articles of clothing. The washing system 300 generally includes a wash tank 305 that receives water from a water supply 310. The washing system 300 also includes a dispensing system 315 having a controller 320 and a sensor 325. As described in greater detail below, the dispensing system 315 may be configured similarly to the dispensing system 100 shown in FIGS. 1 and 2, having a dispensing closure or other device that provides a predetermined (e.g., a measured) amount of material to the tank 305. In other embodiments, the washing system 300 may include more or fewer components than those shown in FIG. 3. For example, in some embodiments, the washing system 300 also includes additional tanks (e.g., a rinse tank, a pre-rinse tank, one or more other wash tanks, etc.).

The water supply 310 provides water to the tank 305 and the dispensing system 315. As such, the water supply 310 may have one or more associated valves (e.g., solenoid valves) to control the supply of water to the tank 305 and the dispensing system 315. In such embodiments, the valves may be controlled by the dispensing system 315 or another control system. As described in greater detail below, water may be supplied to the tank 305 to fill the tank (e.g., an initial fill operation) or to supplement water that is removed from the tank 305.

As described above, the dispensing system 315 may be configured similarly to the dispensing system 100 shown in FIG. 1, in that the dispensing system 315 can include a dispensing closure which provides a predetermined amount of material to the tank 305. For example, for each actuation of the dispensing closure, one gram of material can be provided to the tank 305. In other embodiments, an alternative type of fixed quantity (e.g., volume or weight) material metering and material dispensing apparatus may be employed.

Generally, the controller 320 is a suitable electronic device, such as, for example, a programmable logic controller ("PLC"), a computer, a microcontroller, a microprocessor, and/or other industrial/personal computing device. As such, the controller 320 may include both hardware and software components, and is meant to broadly encompass the combination of such components. The controller 320 is responsible for executing a variety of tasks and/or processes. For example, in some embodiments, the controller 320 determines when to actuate the water supply 310 (e.g., to fill or maintain the water level in the tank), as well as when to dispense material into the tank (e.g., to attain or maintain a pre-determined material concentration in the tank). Additionally, the controller 320 can, in some embodiments, execute a training mode or process (see, for example, the process shown with respect to FIG. 4), which stores a set of operational data that can be used to control future washing system tasks.

To carry out the tasks and/or processes, the controller 320 can communicate with a variety of components of the washing system 300. These communications may be wired or wireless. For example, to control the water supply, the controller 320 transmits a signal to the one or more valves associated with the water supply to turn the valves on or off. Additionally, to determine when to dispense material into the tank, the controller 320 receives and processes a signal from the sensor 325 positioned in the tank (as described in greater detail below). In other embodiments, the controller 320 may also be in communication with other components of the washing system 300 (e.g., other sensors, valves, and the like) and/or with external components interfaced with the controller 320. For example, in some embodiments, the controller 320 may be in communication with a server or other storage device, allowing the controller 320 to upload and/or communicate data (e.g., operational parameters) of the washing system.

The sensor 325 is positioned in the tank 305 and transmits a signal to the controller 320 indicative of a material concentration (e.g., the material concentration of the water in the tank 305). In some embodiments, the sensor 325 is mounted permanently within the tank 305. In other embodiments, the sensor 325 may be removed from the tank 305 after use. For example, as described with respect to FIG. 4 below, the sensor 325 may be removed after a training mode or process is completed. As such, in some embodiments, the sensor 325 can be configured as a portable washing system setup or training device (or a component of a training package that includes, for example, the sensor 325, a wired or wireless communication component, etc.). For example, the sensor 325 can be installed in a tank (such as the tank 305) during installation and setup of the washing system 300, and then removed to be utilized in a different washing system after the setup has been completed.

The sensor 325 can be configured to measure a variety of different parameters of the tank, which can be used to determine the concentration of material in the tank. For example, in some embodiments, the sensor 325 is a conductivity sensor that measures the conductivity of the water in the tank 305. That conductivity data is then used to determine the concentration of material in the tank 305. In other embodiments, the sensor 325 may be an alternative type of sensor whose signal can be used to determine a concentration of material in the tank 305. For example, the sensor 325 may be an infra-red ("IR") sensor, an ultraviolet ("UV") absorber, an oxidation-reduction potential ("ORP") sensor, or other type of sensor.

In some embodiments, the sensor 325 also includes a temperature sensing capability. For example, in addition to transmitting a signal indicative of the conductivity of the tank 305, the sensor 325 can transmit a signal that is indicative of the temperature of the tank 305. The temperature data can then be used to provide a more accurate representation of the concentration of the material in the tank 305. Additionally or alternatively, the sensor 325 (or an additional sensor) can be used to measure the relative hardness of the water being added to the tank 305.

In some embodiments, the signal (or signals) from the sensor 325 is used to determine the material concentration in the tank 305. However, in other embodiments, the water supply 310 (and associated water supply valve) can be used to determine material concentration. For example, the material concentration in the tank 305 is reduced as fresh water is added. Thus, a correlation can be determined between the amount of water that is added to the tank 305 (or a time duration that the water supply valve is active) and the resulting material concentration in the tank 305.

In some embodiments, the material being added to the wash tank 305 is a detergent. In other embodiments, however, the dispensing system 315 may be adapted to dispense more than one type of material (e.g., a detergent, a sanitizer, a rinse aid, bleach, etc.). In such embodiments, several sensors 325 may be required to measure material concentrations for each material being added.

The embodiment described with respect to FIG. 3 includes a washing system having a wash tank that is filled with water. Material is added to the water to create a water/material solution. However, as should be appreciated by one of ordinary skill in the art, components similar to those shown and described with respect to FIG. 3 may be applied in an alternative system in which material is added to a liquid that is not water. For example, a facility that produces beverages may implement a material dispensing system which provides a material to a beverage solution. Alternatively, a gasoline refining facility may implement a material dispensing system that provides an additive to the gasoline. Other alternatives are also possible. In such embodiments, controlling and sensing devices (such as the controller 320 and the sensor 325) can be utilized.

Figure 4:
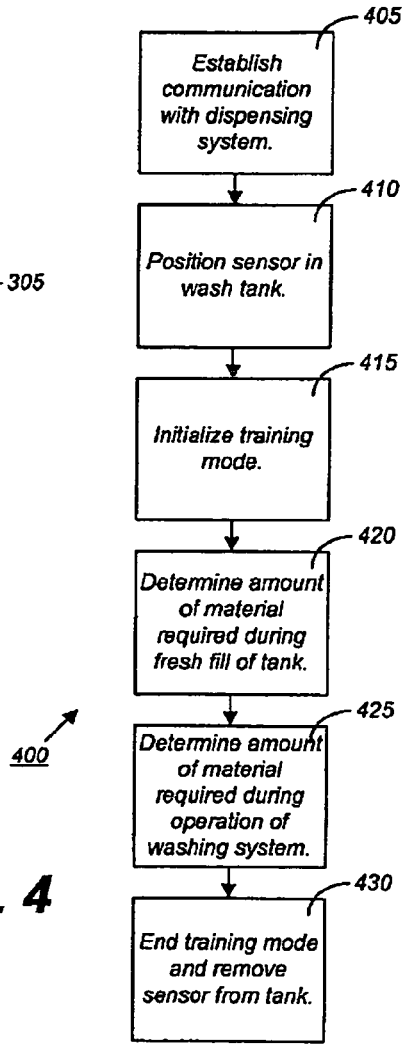
FIG. 4 illustrates an exemplary process for gathering and storing data and/or operational parameters of a wash machine.
Figure 5:
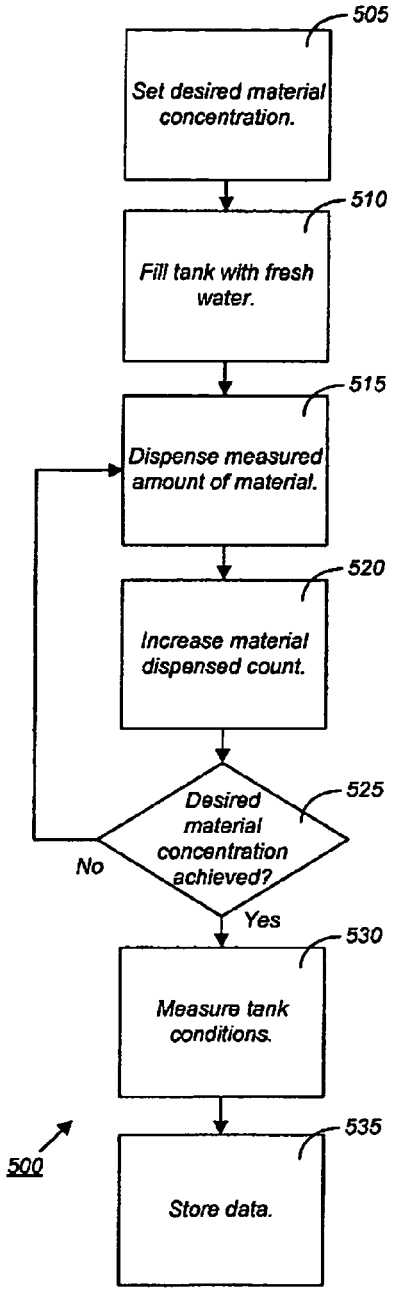
FIG. 5 illustrates an exemplary process for gathering data during a fresh fill operation of a washing system.
Figure 6:
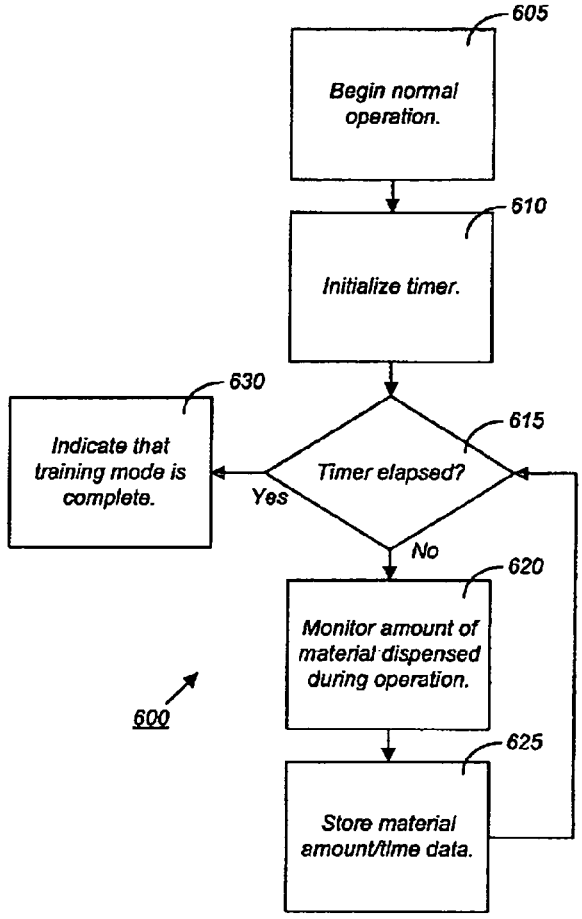
FIG. 6 illustrates an exemplary process for gathering data during operation of a washing system.

FIGS. 4-6 illustrate exemplary processes and/or sub-processes that can be used to determine operational parameters of a washing system, and store those operational parameters for subsequent use. The embodiments of FIGS. 4-6 are described herein as being implemented with the washing system 300 shown in FIG. 3. However, as should be apparent to one of ordinary skill in the art, the embodiments may be utilized with an alternative washing system.

FIG. 4 illustrates an exemplary process 400 for gathering and storing data related to operations of a washing system. For example, as described in greater detail below, the process 400 can be used to implement a training mode in which operational data and/or parameters of the washing system 300 are gathered and stored. The process 400 begins by establishing a communication link between the sensor 325 and the dispensing system 315 (step 405). As described above, this communication link may be wired or wireless. After establishing the communication link, the sensor 325 can be positioned within the tank 305 (step 410). In some embodiments, the step 410 and the step 405 may be transposed. For example, the sensor 325 may be positioned in the tank 305 prior to establishing a communication link with the dispensing system 315. Additionally, in embodiments that include a tank 305 having an integral (or permanently installed) sensor 325, step 410 can be omitted.

After installation of the sensor 325 and establishment of a communication link between the sensor 325 and the dispensing system 315, a training mode or learning mode can be initialized (step 415). As described in greater detail with respect to FIGS. 5 and 6, the training mode can be used to gather and store operational parameters of the washing system 300. For example, the training mode can be used to establish a volumetric amount of material (e.g., a number of doses of material) that is required to attain a certain material concentration during an initial or first run of the washing system (e.g., a "fresh fill"), when fresh water is used to fill the tank 305. Additionally, the training mode can be used to establish a volumetric amount of material (e.g., a number of doses of material) that is required to maintain a certain material concentration over time (e.g., while the washing system is in use). These operational parameters can then be used by the washing system 300 during subsequent uses.

To initialize the training mode (step 415), a user may actuate an input (e.g., a switch, knob, pushbutton, or the like) on a control panel of the dispensing system 315. Actuation of the input then transmits a signal to the controller 320, thereby alerting the controller 320 to initialize the training mode. In another embodiment, the training mode may be initialized without a prompt from a user. For example, the training mode may be initialized automatically by the controller 320 upon establishing communication with the sensor 325. Alternatively or additionally, the training mode may be initialized by the controller 320 after a predetermined time duration has expired and/or after a predetermined number of washing system cycles.

After the training mode has been initialized, operational parameters of the washing system 300 can be established and stored. For example, an amount of material (e.g., a number of material doses) that is required to attain a material concentration during an initial fresh water fill of the tank 305 can be determined (step 420) (e.g., the process of FIG. 5). Additionally, an amount of material that is required to maintain a material concentration while the washing system 300 is operating can be determined (step 425) (e.g., the process of FIG. 6). Upon completion of the training mode, the sensor 325 can be removed from the tank 305 (step 430). In some embodiments, the sensor 325 may remain in the tank 305 for future use.

By monitoring and storing the operational parameters of the dispensing system 315, the operational parameters can be used for future operations of the washing system 300. For example, each fresh fill and subsequent use of the washing system 300 that is carried out after the training mode has been completed can implement the same operational parameters as were stored during the training mode. More specifically, if "X" doses of material were required to achieve the desired material concentration during a fresh fill, and "Y" doses of material were required over a certain time period (or, alternatively, for a certain amount of water), then each subsequent fresh fill and operation can use "X" and "Y" doses of material without having to monitor the material concentration. This can lead to reduced cost and general upkeep of the washing system 300, because the sensor 325 is not needed after the training mode is completed. Thus, the sensor 325 does not need to be permanently installed and maintained within the washing system 300. Since the sensor is not permanently installed, more expensive and sophisticated sensors can be utilized to carry out the training mode.

In other embodiments, the operational parameters of the dispensing system 315 can be monitored and stored for use in a redundant or backup mode. For example, washing systems that include a permanently installed sensor may continually monitor the operational parameters, and not rely on stored operational parameters to operate. However, in the event of a sensor failure, the stored operational parameters can be utilized as a backup until the sensor can be repaired, replaced, or removed.

FIG. 5 illustrates an exemplary process 500 for gathering data during an initial filling operation ("fresh fill") of the washing system 300 (e.g., filling an empty tank 305 with water and adding material to achieve a desired concentration, as described below). In some embodiments, the process 500 may be implemented as a portion of a larger washing system process that is executed by the controller 320. For example, in some embodiments, the process 500 is a sub-process corresponding to the step 420 in process 400 (see FIG. 4). As such, the process 500 is described as being carried out during the training mode that is initialized in step 415 of FIG. 4. In other embodiments, however, the process 500 may be executed independently of the other processes described herein.

The first step in the process 500 is to set a desired material concentration level for the tank 305 of the washing system 300 (step 505). For example, a user can determine a concentration level that is required to effectively clean the articles positioned within the tank 305. The user can enter this desired concentration into the controller 320 using a user input included on the dispensing system 315. In some embodiments, step 505 is completed by an installation professional after the washing system 300 has been installed in a location. In other embodiments, step 505 can be completed manually by a washing system operator or automatically without user input.

Next, the tank 305 is filled with water (step 510) and material is dispensed into the tank 305 (step 515). In some embodiments, material is dispensed into the tank 305 using a dispensing system having a dispensing closure (such as the dispensing closure 115 shown in FIGS. 1 and 2), which allows a metered or known "dose" of material to be dispensed. More than one dose of material may be required to achieve the desired concentration during a fresh fill. Accordingly, while the material is being dispensed in the tank 305 (step 515), a material counter can be incremented after each dose of material dispensed (step 520). Additionally, the material concentration in the tank 305 can be verified after each dose is delivered (step 525). In some embodiments, the material concentration is calculated by the controller 320. For example, if the sensor 325 is a conductivity sensor, the controller 320 may calculate the material concentration using a known conversion factor and/or equation. In some embodiments, as described above, other factors are also used by the controller 320 to determine the material concentration (e.g., the temperature of the liquid in the tank 305). If the concentration has not yet reached the desired concentration (set in step 505), the process 500 returns to step 515 and another dose of material is added to the tank 305.

After the tank 305 has achieved the desired material concentration, the conditions that produced the desired concentration are monitored and/or measured (step 530) and stored (step 535). For example, in some embodiments, the number of doses required to achieve the desired concentration are monitored and stored. Additionally, the temperature of the liquid in the tank 305 can be measured and stored. In other embodiments, the date and time that the process 500 was initialized are identified and stored. Other factors (e.g., the size of the tank 305 and/or the amount of water required to fill the tank 305, a washing system identification number, a water hardness variable, etc.) can also be monitored and stored with the material dose data.

FIG. 6 illustrates an exemplary process 600 for gathering operational parameters and data during operation of a wash machine (e.g., after the fresh fill, while the washing system 300 is being used to wash articles positioned in the tank 305). In some embodiments, the process 600 may be implemented as a portion of a larger washing system process that is executed by a controller (such as the controller 320) during the operation of the washing system 300. For example, in some embodiments, the process 600 is a sub-process corresponding to the step 425 in process 400 (see FIG. 4). As such, the process 600 is described as being carried out during the training mode that is initialized in step 415 of FIG. 4. In other embodiments, however, the process 600 may be executed independently of the other processes described herein.

The process 600 begins by initializing operation of the washing system 300 (step 605). Additionally, a timer is initialized (step 610). The duration of the timer may vary according to the location and intended use of the washing system 300. For example, in some embodiments, the washing system 300 is used to wash dishes in a restaurant that serves breakfast, lunch, and dinner. Accordingly, the duration of the timer may be long enough to capture the material dispensing variations associated with each of the meals. For example, relatively more material may be used to maintain the desired material concentration during peak meal times, and relatively less material may be used to maintain the material concentration during non-peak times. In other embodiments, the duration of the timer may be longer or shorter than an entire day (e.g., 1 hour, 4 hours, 8 hours, etc.). In this way, the timer can be optimized to the operational constraints of the setting in which the washing system 300 is installed (e.g., a restaurant, a cafeteria, a hotel, etc.). By employing a timer, the training mode can be automatically started and stopped without intervention by a user. In other embodiments, as described below, a user may manually start and stop the training mode. Accordingly, timer-related steps may be omitted from the process 600.

After the timer has been initialized (step 610), a check is made to verify that the timer has not yet elapsed (step 615). If the timer has not yet elapsed, the operational parameters of the washing system 300 are monitored (step 620). For example, for embodiments in which the washing system 300 is utilized as a dish washing machine (e.g., dishes are loaded into the tank 305 and washed), the material concentration of the tank 305 may be reduced due to soil being washed from the dishes and deposited in the tank 305. Additionally, fresh water may enter the tank 305 while the dishes are being rinsed, thereby reducing the material concentration. Accordingly, material may be added during operation of the washing system 300 to maintain the desired concentration level. In some embodiments, the amount of material that is added is tracked by monitoring the number of doses of material that are added. Additionally, the amount of time that passes between each material dose may be monitored.

Each of the monitored parameters (e.g., number of material doses, time between each dose, temperature of the liquid in the tank 305, water hardness in the tank, amount of water added to the tank 305, etc.) are also stored (step 625) in a memory associated with the controller 320. For example, each time that the dispensing system 315 dispenses material to achieve the desired concentration, the number of doses of material that are dispensed is stored (step 625). Additionally, the frequency at which the dispensing system 315 dispenses material is stored (step 625).

The operational parameters continue to be monitored and stored until the timer has elapsed. After the timer has elapsed, an indication can be provided that the training mode is complete (step 630). This indication may be audible or visual. For example, in some embodiments, a light included on the dispensing system 315 flashes after the training mode has been completed.

The embodiments described with respect to FIGS. 3-6 are directed generally to washing systems. However, as described above, and as should be appreciated by one of ordinary skill in the art, a material dispensing and monitoring system can be adapted to a variety of applications. For example, commercial and residential pool applications may require chemicals and/or other materials to be maintained at certain material concentrations. In other embodiments, boiler systems, cooling towers, water treatment facilities, and the like, may require chemicals and/or other materials to be maintained at certain material concentrations.

Various features and embodiments of the invention are set forth in the following claims.

What is claimed is:

1. A method of determining one or more operational parameters of a washing system having a wash tank to which water and material are added, and a dispenser for dispensing the material, the method comprising:

establishing a communication link between a sensor and a controller, the sensor positioned in the wash tank and configured to transmit a signal indicative of a material concentration, the controller configured to receive the signal;

adding material to water in the wash tank during a first time period;

receiving, by the controller, data indicative of an amount of material dispensed by the dispenser during the first time period;

monitoring the material concentration during operation of the washing system over the first time period and stopping the material addition upon the material concentration reaching a predetermined material concentration;

determining, by the controller, an operational parameter indicative of the amount of material that has been added to reach the predetermined material concentration during the first time period;

storing the operational parameter; and later controlling the washing system using the operational parameter during a second time period.

2. The method of claim 1, further comprising determining, by the controller, an amount of water in the wash tank by monitoring a duration of time that a water supply valve is open, and determining a correlation between the amount of water that is in the wash tank and the amount of material that is added to the wash tank.

3. The method of claim 2, further comprising utilizing the determined correlation to control an amount of material that is added to the wash tank.

4. The method of claim 1, wherein the material is added to the wash tank using a metering device which delivers a predetermined amount of material to the wash tank.

5. The method of claim 1, wherein the sensor is a conductivity sensor.

6. A system for determining one or more operational parameters of a washing system having a wash tank to which water and material are added, the system comprising:

a sensor configured to be positioned in the wash tank and to generate a first signal indicative of a material concentration; and a dispensing device configured to deliver material to the wash tank in one or more doses of a metered volume during a first time period, the dispensing device having a controller configured to receive the first signal from the sensor and data indicative of an amount of material dispensed by the dispensing device during operation of the washing system over the first time period, the controller programmed to determine the material concentration of the wash tank, and to actuate the delivery of one or more doses of material by the dispensing device to maintain the material concentration of the wash tank at approximately a predetermined level, each of the one or more delivered doses increasing the material concentration of the wash tank, the controller further programmed to determine a correlation between the change in material concentration and the number of doses that was delivered by the dispensing system during the first time period, and to store the determined correlation for a subsequent washing system operation during a second time period.

7. The system of claim 6, wherein the sensor is a conductivity sensor.

8. The system of claim 6, further comprising a water supply having an associated water supply valve, the water supply valve receiving a second signal from the controller to turn the water supply on, thereby supplying water to the wash tank.

9. The system of claim 8, wherein the controller is configured to determine an amount of water that is added to the wash tank by monitoring a duration of time that the water supply valve is on.

10. The system of claim 9, wherein the controller is configured to determine a correlation between the amount of water supplied to the wash tank and the amount of material supplied to the wash tank.

11. The system of claim 6, wherein the controller is configured to determine the correlation between the material concentration and the amount of material that is dispensed into the wash tank during a training mode having a predetermined length, the training mode including a first stage in which water and material are added to a relatively empty wash tank, and a second stage in which water and material are added to a non-empty wash tank.

12. The system of claim 6, wherein the washing system is a dish washing system and the material is a detergent.

13. The system of claim 6, wherein the sensor is a portable device that is configured to be removable from the wash tank.

14. A method of determining one or more operational parameters of a washing system having a wash tank to which water and material are added, the method comprising:

receiving, by a controller, from a sensor, a signal indicative of a material concentration in the wash tank;

supplying the wash tank with one or more doses of material by actuating a material delivery device having a chamber of a predetermined size that is filled with material prior to supplying the material to the wash tank, each actuation of the material delivery device supplying a single dose of material to the wash tank, the material being delivered until a desired material concentration is achieved in the wash tank;

determining, by the controller, an amount of material that was delivered to achieve the desired material concentration in the wash tank by counting the number of actuations of the material delivery device required to achieve the desired material concentration in the wash tank;

recording, by the controller, the determined number of actuations; and removing the sensor from the wash tank after the controller has recorded the amount of material required to achieve the desired material concentration for a predetermined duration of time.

15. The method of claim 14, further comprising supplying water to the wash tank during a fresh fill stage in which the wash tank is initially empty and is subsequently relatively full, and recording, by the controller, the amount of material required to achieve the desired material concentration during the fresh fill stage.

16. The method of claim 14, further comprising supplying water to the wash tank during an operational stage in which water in the wash tank is being soiled and fresh water is being added to the wash tank, and recording, by the controller, the amount of material required to maintain the desired material concentration.

17. The method of claim 14, further comprising supplying the wash tank with a metered amount of material by actuating a material metering device, wherein each actuation of the material metering device is recorded by the controller.

* * * * *

UNITED STATES PATENT AND TRADEMARK OFFICE

CERTIFICATE OF CORRECTION

PATENT NO. : 8,584,690 B2
APPLICATION NO. : 12/674264
DATED : November 19, 2013
INVENTOR(S) : Ashton et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 539 days.

Signed and Sealed this
Twenty-second Day of September, 2015

Michelle K. Lee

Michelle K. Lee
*Director of the United States Patent and Trademark Office*